US010228140B2

(12) United States Patent
Cihlar et al.

(10) Patent No.: US 10,228,140 B2
(45) Date of Patent: Mar. 12, 2019

(54) GAS-ONLY CARTRIDGE FOR A PREMIX FUEL NOZZLE

(71) Applicant: General Electric Company, Schenectady, NY (US)

(72) Inventors: David William Cihlar, Greenville, SC (US); Patrick Benedict Melton, Horse Shoe, NC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 345 days.

(21) Appl. No.: 15/046,482

(22) Filed: Feb. 18, 2016

(65) Prior Publication Data

US 2017/0241644 A1 Aug. 24, 2017

(51) Int. Cl.

| | |
|---|---|
| ***F23D 3/30*** | (2006.01) |
| ***F23R 3/28*** | (2006.01) |
| ***F23R 3/14*** | (2006.01) |
| ***F23D 14/02*** | (2006.01) |
| ***F23R 3/30*** | (2006.01) |
| ***F23R 3/32*** | (2006.01) |
| ***F23R 3/46*** | (2006.01) |

(Continued)

(52) U.S. Cl.

CPC ..... *F23R 3/28* (2013.01); *F23D 14/02* (2013.01); *F23D 14/58* (2013.01); *F23R 3/14* (2013.01); *F23R 3/286* (2013.01); *F23R 3/30* (2013.01); *F23R 3/32* (2013.01); *F23R 3/46* (2013.01); *F23D 17/002* (2013.01); *F23D 2204/10* (2013.01); *F23D 2900/00016* (2013.01); *F23D 2900/14021* (2013.01); *F23D 2900/14701* (2013.01); *F23R 3/36* (2013.01)

(58) Field of Classification Search

CPC .... F23D 14/02; F23D 17/002; F23D 2204/10; F23D 2900/14021; F23D 2900/14701; F23R 3/14; F23R 3/30; F23R 3/32; F23R 3/36; F23R 3/286

See application file for complete search history.

(56) References Cited

U.S. PATENT DOCUMENTS 4,850,194 A 7/1989 Fuglistaller et al.
5,062,792 A * 11/1991 Maghon ..... F23C 7/004 239/400

(Continued)

OTHER PUBLICATIONS

Extended European Search Report and Opinion issued in connection with corresponding EP Application No. 7156619.3 dated Oct. 16, 2017.

*Primary Examiner* — Steven Sutherland
*Assistant Examiner* — Marc Amar
(74) *Attorney, Agent, or Firm* — Dority & Manning, P.A.

(57) ABSTRACT

A gas-only cartridge for a fuel nozzle includes a flange that defines a plurality of apertures for receiving a gaseous fuel, an outer tube that is coupled to the flange and an inner tube that extends axially within the outer tube. The inner tube and the outer tube define a fuel passage therebetween and the fuel passage is in fluid communication with the plurality of apertures of the flange. A fuel distribution tip is disposed at a downstream end of the gas-only cartridge and defines a plurality of fuel ports circumferentially spaced along and annularly arranged about an outer surface of the fuel distribution tip. The fuel ports are in fluid communication with the fuel passage.

12 Claims, 6 Drawing Sheets

(51) Int. Cl.

| | |
|---|---|
| ***F23D 14/58*** | (2006.01) |
| *F23R 3/36* | (2006.01) |
| *F23D 17/00* | (2006.01) |

(56) References Cited

U.S. PATENT DOCUMENTS

| | | | | |
|---|---|---|---|---|
| 5,408,830 | A | 4/1995 | Lovett | |
| 6,446,439 | B1 * | 9/2002 | Kraft | F23R 3/286 60/739 |
| 8,418,469 | B2 * | 4/2013 | Myers | F23D 11/402 60/737 |
| 8,464,537 | B2 * | 6/2013 | Khan | F23R 3/286 60/737 |
| 2004/0045295 | A1 * | 3/2004 | Wiebe | F23D 14/78 60/737 |
| 2006/0059915 | A1 * | 3/2006 | Furletov | F23D 11/24 60/740 |
| 2009/0165436 | A1 | 7/2009 | Herbon et al. | |
| 2010/0024425 | A1 * | 2/2010 | Cihlar | F02C 7/22 60/734 |
| 2010/0064690 | A1 * | 3/2010 | Bailey | F02C 7/22 60/734 |
| 2010/0293954 | A1 * | 11/2010 | Widener | F23D 14/48 60/740 |
| 2011/0005229 | A1 * | 1/2011 | Venkataraman | F23D 11/38 60/737 |
| 2011/0197589 | A1 * | 8/2011 | Khosla | F23D 11/16 60/746 |
| 2011/0314827 | A1 * | 12/2011 | Khosla | F23R 3/14 60/742 |
| 2012/0102957 | A1 * | 5/2012 | Myers | F23R 3/286 60/737 |
| 2012/0180490 | A1 * | 7/2012 | Takami | F23R 3/14 60/740 |
| 2012/0248217 | A1 * | 10/2012 | Bunker | F23R 3/14 239/5 |
| 2013/0219899 | A1 * | 8/2013 | Uhm | F23R 3/14 60/738 |
| 2015/0176841 | A1 * | 6/2015 | Barker | F23R 3/286 60/737 |
| 2016/0186662 | A1 | 6/2016 | Stewart | |
| 2016/0305668 | A1 * | 10/2016 | Romig | F23R 3/343 |

* cited by examiner

GAS-ONLY CARTRIDGE FOR A PREMIX FUEL NOZZLE

FEDERAL RESEARCH STATEMENT

This invention was made with government support under Contract No. DE-FC26-05NT42643 awarded by the Department of Energy. The government has certain rights in the invention.

FIELD OF THE TECHNOLOGY

The subject matter disclosed herein relates to a fuel nozzle for a combustion system. More particularly, the disclosure is directed to a gas-only cartridge for pre-mixing fuel and a purge gas for combustion within a combustion chamber of the combustion system.

BACKGROUND

Gas turbines operate by combusting fuel in a combustion system or a plurality of combustors to create a high-energy combustion gas that passes through a turbine, thereby causing a turbine rotor shaft to rotate. The rotational energy of the rotor shaft may be converted to electrical energy via a generator coupled to the rotor shaft. Each combustor generally includes fuel nozzles that may provide premixing of the fuel and air upstream of the combustion zone, as a means to keep nitrogen oxide (NOx) emissions low.

Gaseous fuels, such as natural gas, often are employed as a combustible fluid in gas turbine engines used to generate electricity. In some instances, it may be desirable for the combustion system to be able to combust liquid fuels, such as distillate oil, with no changes to the combustion hardware. A configuration with both gas and liquid fuel capability is called a "dual fuel" combustion system. In a typical configuration, the liquid fuel injection is provided though cartridges that fit in the center of the gas premixing fuel nozzles.

To provide an operator of the gas turbine with the ability to switch between gas-only operation and dual-fuel operation, conventional fuel nozzles may be installed with blank or dummy cartridges that may be easily replaced with liquid fuel cartridges. These blank cartridges, which are used for gas-only operation, merely fill the space in the center of the fuel nozzle that may eventually be occupied by a liquid fuel cartridge. The blank cartridges are typically purged with air to cool the tips of the cartridges, which face the combustion zone, to keep the tips at an acceptable temperature.

A large portion of gas turbine operators rely primarily on the combustion of gaseous fuels and employ the gas only configuration of the combustion system. During operation the combustion system directs purge flow through or around a tip portion of the blank cartridge. While this purge flow is generally a small fraction of the total flow through the combustor, the purge flow does not participate in the fuel/air premixing prior to combustion and, thus, does not contribute to a reduction in NOx emissions. It is generally desirable and often required by regulations to keep gas turbine NOx emissions at the lowest achievable level.

BRIEF DESCRIPTION OF THE TECHNOLOGY

Aspects and advantages are set forth below in the following description, or may be obvious from the description, or may be learned through practice.

One embodiment of the present disclosure is a gas-only cartridge for a fuel nozzle. The gas-only cartridge includes a flange that defines a plurality of apertures for receiving a gaseous fuel. An outer tube is coupled to the flange and extends axially outwardly from the flange. An inner tube extends axially within the outer tube such that the inner tube and the outer tube define a fuel passage radially therebetween. The fuel passage is in fluid communication with the plurality of apertures of the flange. A fuel distribution tip is disposed at a downstream end of the gas-only cartridge. The fuel distribution tip defines a plurality of fuel ports circumferentially spaced along and annularly arranged about an outer surface of the fuel distribution tip. The fuel ports are in fluid communication with the fuel passage.

Another embodiment of the present disclosure is a fuel nozzle. The fuel nozzle includes a center body and a tip body disposed at a downstream end of the center body. The tip body defines an opening that extends axially through the tip body and includes a plurality of channels circumferentially spaced and position along an inner surface of the tip body within the opening. Each channel defines a flow passage through an upstream surface and a downstream surface of the tip body. A gas-only cartridge extends axially within the center body. The gas-only cartridge includes an outer tube, an inner tube that extends axially within the outer tube fuel and a fuel passage defined radially therebetween. The outer tube and the centerbody define a secondary premix air passage therebetween. The gas-only cartridge further comprises a fuel distribution tip that extends at least partially through the opening of the tip body. The fuel distribution tip includes a plurality of circumferentially spaced fuel ports in fluid communication with the fuel passage. Each fuel port is in fluid communication with a respective channel of the tip body and each channel is in fluid communication with the secondary premix air passage.

Another embodiment includes an end cover that is coupled to an outer casing and a fuel nozzle having a base portion coupled to one side of the end cover. The fuel nozzle comprises a center body that is coupled to and coaxially aligned with the base portion. A tip body is disposed at a downstream end of the center body. The tip body defines an opening that extends axially through the tip body and includes a plurality of channels circumferentially spaced and position along an inner surface of the tip body within the opening. Each channel defines a flow passage through an upstream surface and a downstream surface of the tip body. A gas-only cartridge extends axially within the center body. The gas-only cartridge includes an outer tube, an inner tube that extends axially within the outer tube fuel and a fuel passage defined radially therebetween. The outer tube and the centerbody define a secondary premix air passage therebetween. The gas-only cartridge further comprises a fuel distribution tip that extends at least partially through the opening of the tip body. The fuel distribution tip includes a plurality of circumferentially spaced fuel ports in fluid communication with the fuel passage. Each fuel port is in fluid communication with a respective channel of the tip body and each channel is in fluid communication with the secondary premix air passage.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
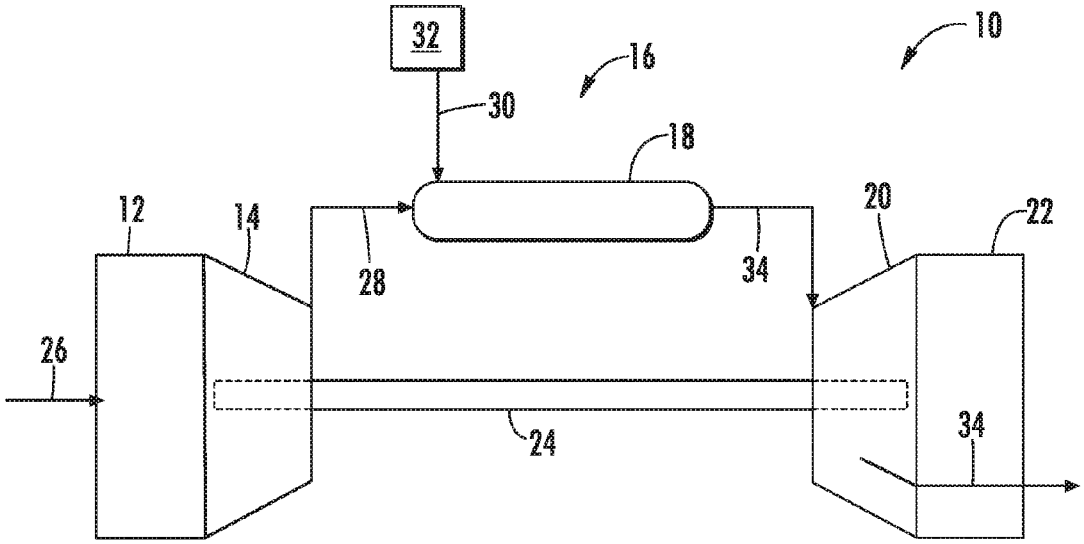
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a fuel nozzle for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, a combustion system 16 including at least one combustor 18 disposed downstream of the compressor 14, a turbine 20 disposed downstream of the combustor 18 and an exhaust section 22 disposed downstream of the turbine 20. Additionally, the gas turbine 10 may include one or more shafts 24 that couple the compressor 14 to the turbine 20.

During operation, air 26 flows through the inlet section 12 and into the compressor 14 where the air 26 is progressively compressed, thus providing compressed air 28 to the combustor 18. Fuel 30 from a fuel supply 32 is injected into the combustor 18, mixed with a portion of the compressed air 28 and burned to produce combustion gases 34. The combustion gases 34 flow from the combustor 18 into the turbine 20, wherein energy (kinetic and/or thermal) is transferred from the combustion gases 34 to rotor blades (not shown), thus causing shaft 24 to rotate. The mechanical rotational energy may then be used for various purposes such as to power the compressor 14 and/or to generate electricity. The combustion gases 34 exiting the turbine 20 may then be exhausted from the gas turbine 10 via the exhaust section 22.

Figure 2:
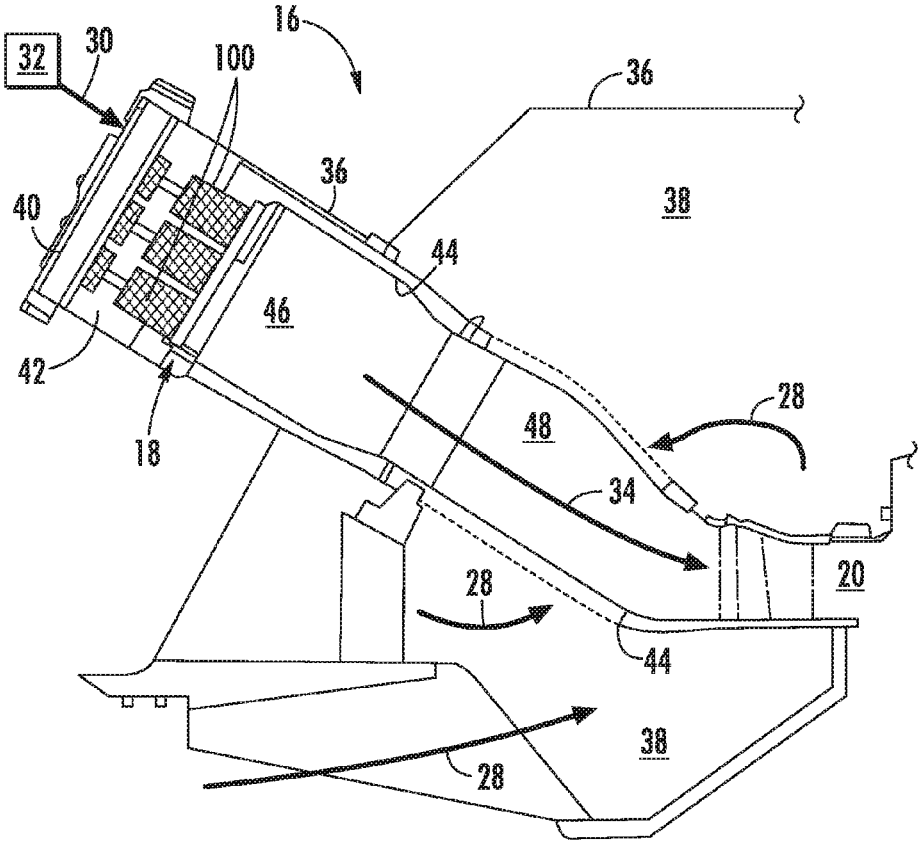
FIG. 2 is a simplified cross-section side view of an exemplary combustor as may incorporate various embodiments of the present disclosure.

As shown in FIG. 2, the combustor 18 may be at least partially surrounded an outer casing 36 such as a compressor discharge casing. The outer casing 36 may at least partially define a high pressure plenum 38 that at least partially surrounds various components of the combustor 18. The high pressure plenum 38 may be in fluid communication with the compressor 16 (FIG. 1) so as to receive the compressed air 28 therefrom. An end cover 40 may be coupled to the outer casing 36. In particular embodiments, the outer casing 36 and the end cover 40 may at least partially define a head end volume or portion 42 of the combustor 18. In particular embodiments, the head end portion 42 is in fluid communication with the high pressure plenum 38 and/or the compressor 14. One or more liners or ducts 44 may at least partially define a combustion chamber or zone 46 for combusting the fuel-air mixture and/or may at least partially define a hot gas path 48 through the combustor for directing the combustion gases 34 towards an inlet to the turbine 20.

In various embodiments, as shown in FIG. 2, the combustor 18 includes one or more fuel nozzles 100 coupled to the end cover 40 and extending towards the combustion chamber 46. Various embodiments of the combustor 18 may include different numbers and arrangements fuel nozzles 100 and is not limited to any particular number of fuel nozzles unless otherwise specified in the claims. For example, in particular configurations the one or more fuel nozzles 100 may include multiple fuel nozzles annularly arranged about a center fuel nozzle.

Figure 3:
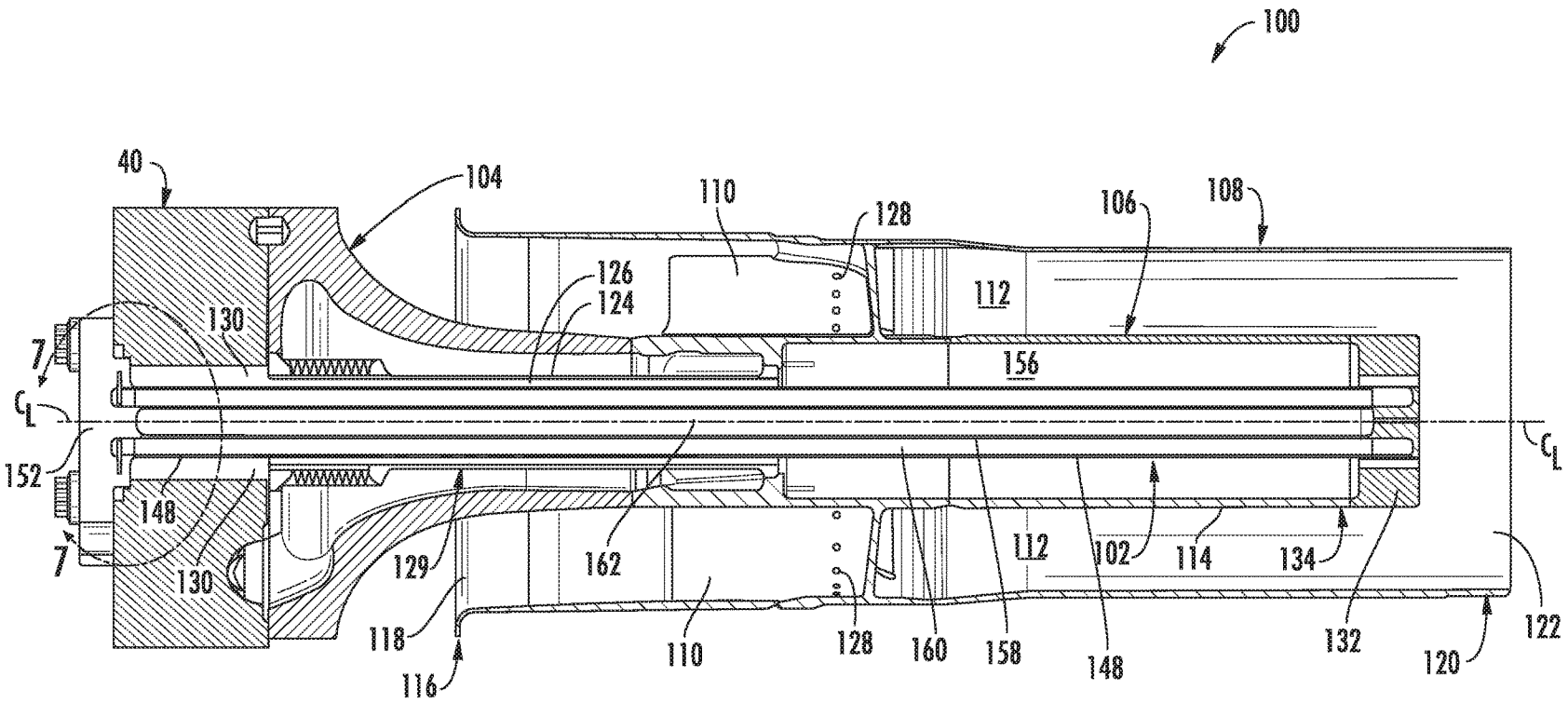
FIG. 3 is a cross sectional side view of an exemplary fuel nozzle as may incorporate one or more embodiments of the present disclosure.

FIG. 3 shows an exemplary fuel nozzle 100 having a gas-only cartridge 102, according to at least one embodiment of the present disclosure. In at least one embodiment, the fuel nozzle 100 includes a base portion 104, a center body 106 having an annular or tube shape, an outer sleeve or burner tube 108 that extends circumferentially around at least a portion of the center body 106 and a plurality of turning vanes 110 that extend between the center body 106 and the outer sleeve 108. The turning vanes 110 are disposed within a primary premix air passage 112 which is defined between the center body 106 and the outer sleeve 108. The center body 106 may be formed from one or more sleeves or tubes 114 coaxially aligned with the base portion 104 along a longitudinal axis or axial centerline of the fuel nozzle 100.

An upstream end portion 116 of the outer sleeve 108 may at least partially define an inlet 118 to the primary premix air passage 112 and a downstream end portion 120 of the outer sleeve 108 may at least partially define an outlet 122 of the primary premix air passage 112. In at least one embodiment, the inlet 118 is in fluid communication with the head end 42 (FIG. 2) of the combustor 18. The base portion 104 may be connected to an inner surface of the end cover 40 via mechanical fasteners or by other connecting means. In particular embodiments, the base portion 104, the center body 106 and the outer sleeve 108 are coaxially aligned along the longitudinal axis of the fuel nozzle 100.

In one embodiment, an inner sleeve 124 may extend axially within the base portion 104 and/or at least a portion of the center body 106 and may at least partially surround a portion of the gas-only cartridge 102. The inner sleeve 124 may at least partially define a fuel circuit or passage 126 for providing fuel to a plurality of fuel ports 128 disposed/defined along one or more of the turning vanes 110. The fuel circuit 126 may be in fluid communication with one or more fuel circuits 130 defined in the end cover 40. The fuel ports 128 are in fluid communication with the primary premix air passage 112. In one embodiment, the fuel circuit 126 may be at least partially defined between a portion of the gas-only cartridge 102 and the inner sleeve 124.

Figure 4:
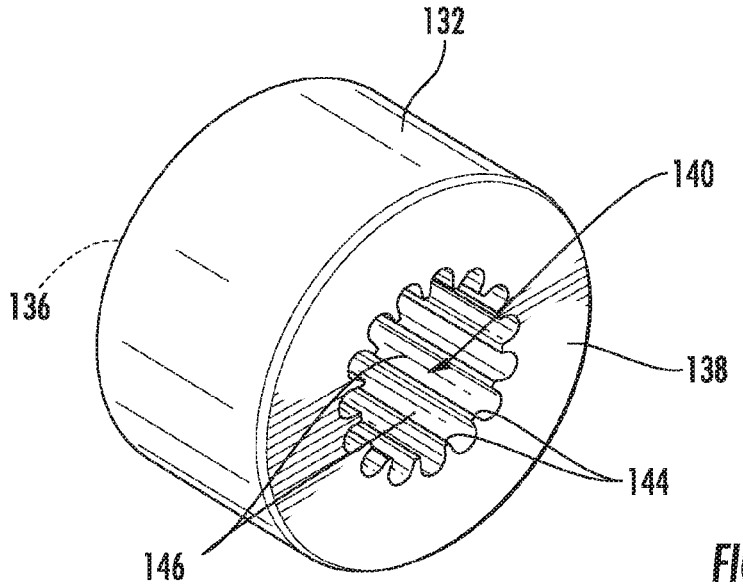
FIG. 4 is an enlarged isometric view of a tip body of the fuel nozzle as shown in FIG. 3 according to at least one embodiment of the present disclosure.
Figure 5:
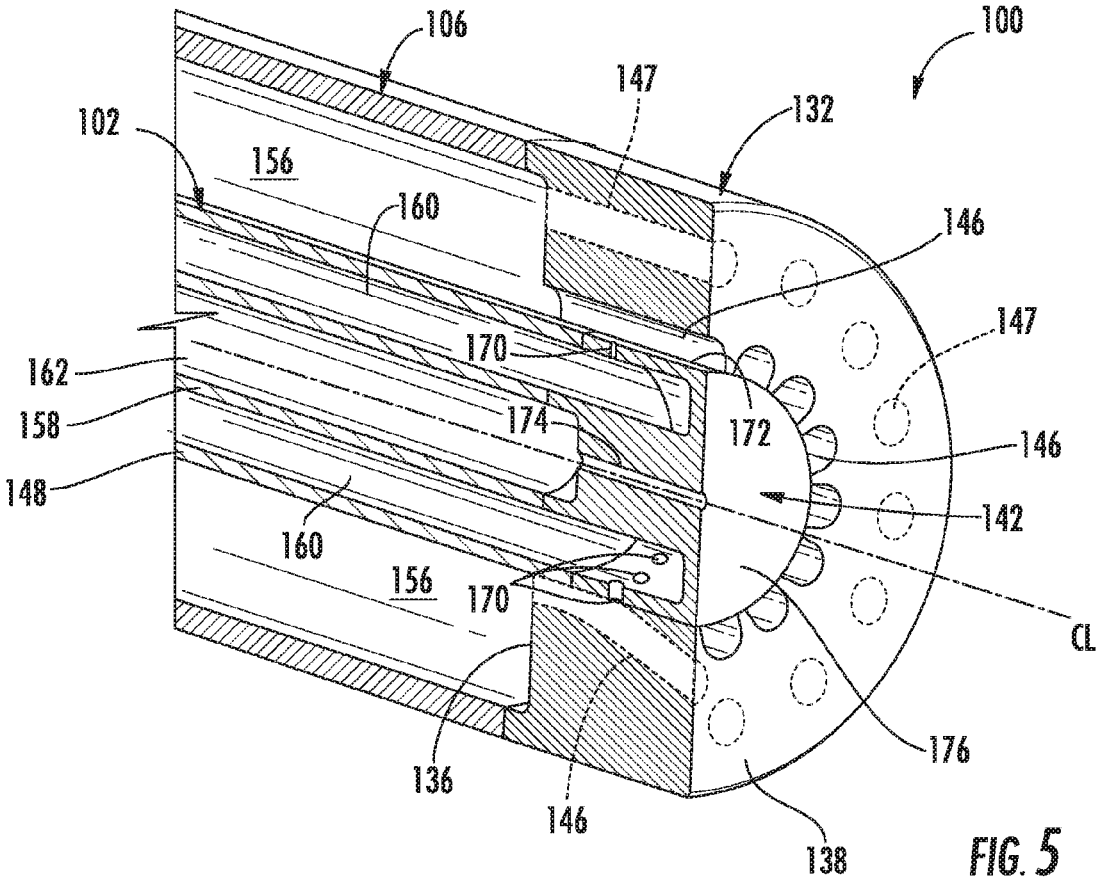
FIG. 5 is an enlarge isometric view of a portion of the fuel nozzle as shown in FIG. 3, according to at least one embodiment of the present disclosure.

In various embodiments, a tip body 132 is disposed at and/or defines a downstream end 134 of the center body 106. FIG. 4 provides an isometric view of the tip body 132 according to at least one embodiment of the present disclosure. FIG. 5 provides a perspective cross sectional view of a portion of the fuel nozzle 100 including a portion of the center body 106 including the tip body 132 and a portion of the gas-only cartridge 102 according to at least one embodiment of the present disclosure. As shown in FIGS. 4 and 5, the tip body 132 includes an upstream side or surface 136 axially spaced from a downstream side or surface 138. The tip body 132 defines an opening 140 (FIG. 4) that extends through the upstream surface 136 and the downstream surface 138. As shown in FIG. 5, the opening 140 may be sized to allow a fuel distribution tip 142 of the gas-only cartridge 102 to extend at least partially therethrough.

In various embodiments, as shown in FIG. 4, an inner surface 144 of the tip body 132 includes and/or defines a plurality of slots, grooves or channels 146 annularly arranged about the opening 140. In particular embodiments, each channel 146 extends through the upstream surface 136 and the downstream surface 138 of the tip body 132 and defines a respective flow path through the tip body 132. The channels 146 may have any cross sectional shape and the particular cross sectional shape of the channels 146 is not limited to a particular cross sectional shape unless otherwise recited in the claims.

The channels 146 may have the same cross sectional shape or may have different cross sectional shapes. In one embodiment, as shown in FIGS. 4 and 5, one or more of the channels 146 may have a substantially "U" cross sectional shape. Other cross sectional shapes may include a "C" or horseshoe shape where walls of each channel 146 meet or engage with the cartridge past perpendicular. In particular embodiments, as shown in dashed lines of FIG. 5, one or more of the channels 146 may be angled with respect to the axial centerline of the fuel nozzle 100. In one embodiment, the channels 146 may be oriented such as in a helical pattern, so as to impart angular swirl to air and/or a fuel and air mixture flowing through the channels 146. In one embodiment, one or more of the channels 146 may be oriented so as direct a flow of fuel-air mixture radially outwardly from the axial centerline towards the outer sleeve 108. In at least one embodiment, the tip body 132 may include and or define a plurality of circumferentially spaced cooling passages, as indicated by dashed lines 147, annularly arranged about or radially outwardly from the channels 146. The cooling passages 147 may provide for fluid communication through the upstream surface 136 and the downstream surface 138 of the tip body 132.

Figure 6:
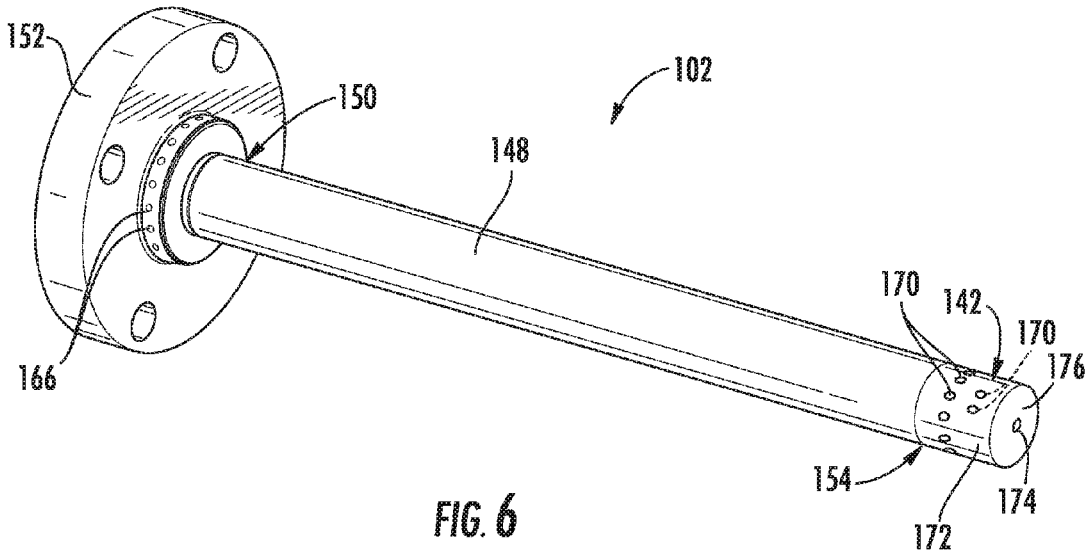
FIG. 6 is a perspective side view of a gas-only cartridge according to at least one embodiment of the present disclosure.

FIG. 6 provides a perspective side view of the gas-only cartridge 102 according to at least one embodiment of the present disclosure. In at least one embodiment, as shown in FIG. 6, the gas-only cartridge 102 includes an outer tube 148. The outer tube 148 may include a first end 150 that is coupled to a base flange 152 and a second end 154 that connected to and/or that at least partially defines the fuel distribution tip 142. As shown in FIG. 3, the base flange 152 may be formed to connect to an outer surface of the end cover 40 and the outer tube 148 may extend through the end cover 40 from the base flange 152. As shown in FIG. 3, when installed into the fuel nozzle 100, the outer tube 148 of the gas-only cartridge 102 and the center body 106 at least partially define a secondary premix air passage 156 therebetween.

As shown in FIGS. 3 and 5, the gas-only cartridge 102 further includes an inner tube 158 that extends axially within the outer tube 148. The outer tube 148 is radially spaced from the inner tube 158 so as to define a fuel passage 160 therebetween. In particular embodiments the inner tube 148 defines an air passage 162 within the gas-only cartridge 102.

Figure 7:
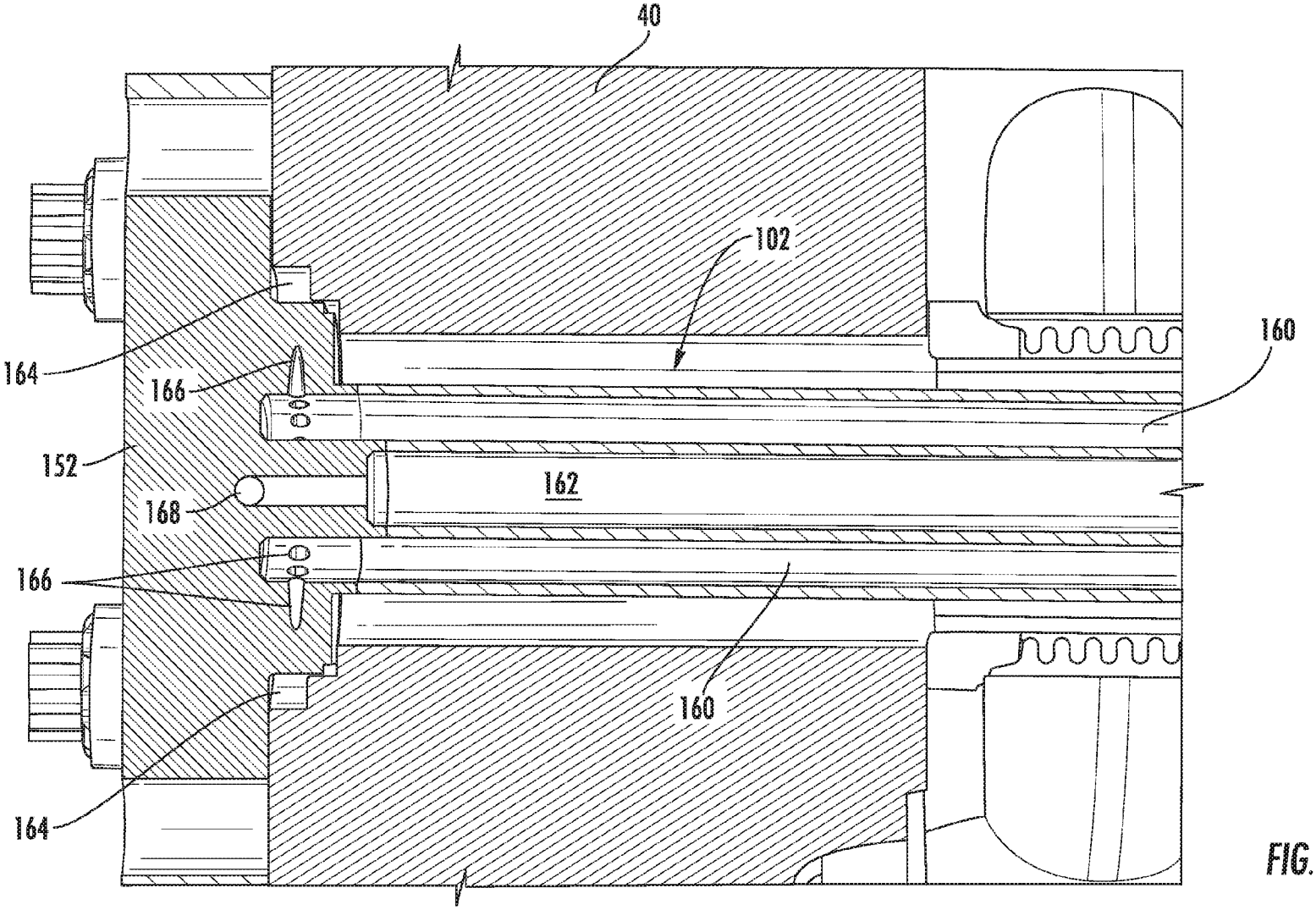
FIG. 7 is an enlarged cross sectional side view of a portion of the fuel nozzle and the gas-only cartridge mounted to an end cover of a combustor according to at least one embodiment of the present disclosure.

FIG. 7 provides an enlarged cross sectional side view of a portion of the gas-only cartridge 102 as shown in FIG. 3, including a portion of the base flange 152 and a portion of the end cover 40 according to at least one embodiment. As shown in FIG. 7, the base flange 152 and/or the end cover 40 may at least partially define a fuel circuit 164 for providing a gaseous fuel to the fuel passage 160 of the gas-only cartridge 102. In particular embodiments, as shown in FIGS. 6 and 7, the base flange 152 may define a plurality of circumferentially spaced apertures 166 that provide for fluid communication between the fuel circuit 164 and the fuel passage 160. In particular embodiments, the base flange 152 may define one or more air circuits for providing a purge or cooling medium to the air passage 162 of the gas-only cartridge 102.

In various embodiments, as shown in FIGS. 5 and 6, the fuel distribution tip 142 includes and/or defines a plurality of fuel ports 170 circumferentially spaced about the fuel distribution tip 142. The fuel ports 170 provide for fluid communication between the fuel passage 160 and one or more of the channels 146. In one embodiment, an outer surface 172 of the fuel distribution tip 142 and the inner surface 144 of the tip body 132 form multiple seals therebetween so as to at least partially fluidly isolate each channel 146 from circumferentially adjacent channels 146.

In various embodiments, as shown in FIG. 5, each fuel port 170 is aligned with and/or in fluid communication with one corresponding channel 146. In particular embodiments, one or more of the fuel ports 170 may be oriented so as to direct a flow of a gaseous fuel radially outwardly from the outer surface 172 of the fuel distribution tip 142 into each respective channel 146 in a direction that is substantially perpendicular to a flow of compressed air flowing through the channel 146. In particular embodiments, one or more of the fuel ports 170 may be angled with respect to the axial centerline of the fuel nozzle 100. For example, one or more of the fuel ports 170 may be angled into or towards the upstream surface 136 of the tip body 132. In addition or in the alternative, in particular embodiments, one or more of the fuel ports 170 may be angled towards the downstream surface 138 of the tip body 132. In one embodiment, as shown in FIG. 6, at least one fuel port 170 is axially offset from circumferentially adjacent fuel ports 170 with respect to an axial centerline of the gas-only cartridge 102.

In one embodiment, as shown in FIGS. 5 and 6, the fuel distribution tip 142 includes and/or defines at least one aperture 174 that provides for fluid communication from the air passage 162 through the fuel distribution tip 142. The aperture 174 generally extends through a downstream surface 176 of the fuel distribution tip 142.

Figure 8:
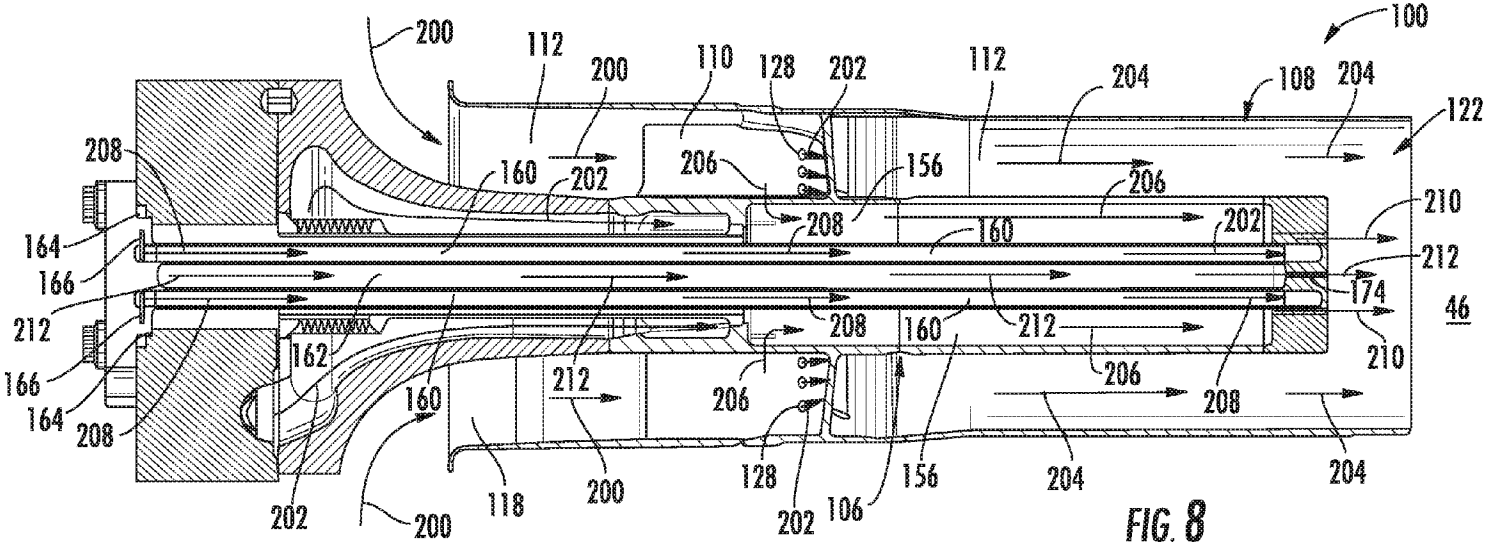
FIG. 8 provides a flow schematic of the fuel nozzle as shown is FIG. 3 according to at least one embodiment of the present disclosure.
Figure 9:
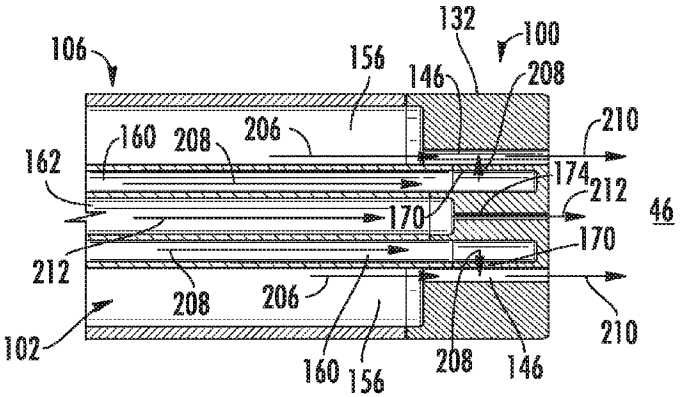
FIG. 9 is a flow schematic of a portion of the fuel nozzle shown in FIG. 8.

FIG. 8 is a flow diagram of the fuel nozzle 100 as shown in FIG. 3, according to at least one embodiment of the present disclosure. FIG. 9 provides an enlarged cross sectional side view of a portion of the fuel nozzle 100 as shown in FIG. 8, including a portion of the center body 106, the tip body 132 and a portion of the gas-only cartridge 102. During premix operation of the fuel nozzle 100, as shown in schematically in FIG. 8, a first portion of compressed air 200 such as the compressed air 28 from the compressor 14 (FIG. 1) enters the inlet 118 of the primary premix air passage 112. The turning vanes 110 impart angular swirl to the first portion of compressed air 200. Gaseous fuel 202 flows into the base portion 104 and is routed to the turning vane 110 where it is injected into the first portion of compressed air 200 via the plurality of fuel ports 128, thereby producing a primary fuel-air mixture downstream from the turning vanes 110. The primary fuel-air mixture 204 flows from the outer sleeve 108 into the combustion chamber or zone 46 (FIG. 2) via the outlet 122.

A second portion of compressed air 206 may be routed into the secondary premix air passage 156. In particular embodiments, the second portion of compressed air 206 is routed from the primary premix air passage 112 through one or more passages or holes defined in and/or by the center body 106 and into the secondary premix air passage 156. As shown in FIGS. 8 and 9, the second portion of compressed air 206 is then routed into each of the channels 146 of the tip body 132. Gaseous fuel 208 flows from the fuel circuit 164 (FIG. 8) and into the fuel passage 160 of the gas-only cartridge 102 via the apertures 166.

As shown in FIG. 9, the gaseous fuel 208 flows into each of the respective channels 146 via fuel ports 170. The second portion of compressed air 206 in each respective channel 146 mixes with the gaseous fuel 208 so as to provide a secondary fuel-air mixture 210 to the combustion chamber 46.

In particular embodiments, a purge or cooling medium 212 such as compressed air flows into and through the air passage 162. The purge medium 212 exits the air passage 162 via the aperture 174 or a plurality of apertures 174, thereby cooling a downstream surface of the fuel distribution tip 142 of the gas-only cartridge 102. In particular embodiments, a portion of the second portion of compressed air 206 may be routed through the cooling passages 147 (FIG. 5), thereby providing cooling to the downstream surface 138 of the tip body 132.

The fuel nozzle 100, particularly the gas-only cartridge 102 as described herein provides various technical benefits over existing dual fuel type fuel nozzles 100. The gas-only cartridge 102 replaces the existing blank or purge air only cartridges with a premixed fuel injection design. The gas-only cartridge 102 as described herein premixes the air 206 with the gaseous fuel 208, thereby improving emissions output without sacrificing durability. Additionally, the separate fuel/air premixing provided by the gas only cartridge 102 may enhance flame stability and improve operability by reducing the tendency for lean blowout and decreasing combustion thermo-acoustic instabilities, also known as dynamics. The gas-only cartridge 102 as described herein maintains adequate cooling of the tip body 132 may be retrofitted into existing combustors with minimal changes and is compatible for a dual fuel application in that the gas-only cartridge 102 may be removed and replaced with a liquid cartridge.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle, comprising:

a center body;

a tip body disposed at a downstream end of the center body, the tip body defining an opening that extends axially through the tip body and including a plurality of channels circumferentially spaced and positioned along an inner surface of the tip body within the opening, wherein each channel defines a flow passage through an upstream surface and a downstream surface of the tip body; and a gas-only cartridge that extends axially within the center body, the gas-only cartridge having an outer tube, an inner tube extending axially within the outer tube and a fuel passage defined therebetween, wherein the outer tube and the centerbody define a secondary premix air passage therebetween, the gas-only cartridge further comprising a fuel distribution tip that extends at least partially through the opening of the tip body, the fuel distribution tip including a plurality of circumferentially spaced fuel ports in fluid communication with the fuel passage, wherein each fuel port is in fluid communication with a respective channel of the tip body and each channel is in fluid communication with the secondary premix air passage.

2. The fuel nozzle as in claim 1, wherein each channel of the plurality of channels is "U" shaped.

3. The fuel nozzle as in claim 1, wherein the inner surface of the tip body forms a seal against an outer surface of the fuel distribution tip between each circumferentially adjacent channel of the plurality of channels.

4. The fuel nozzle as in claim 1, wherein the inner tube of the gas-only cartridge at least partially defines an air passage within the gas-only cartridge.

5. The fuel nozzle as in claim 4, wherein the fuel distribution tip of the gas-only cartridge defines an aperture disposed along a downstream surface of the fuel distribution tip, wherein the aperture is in fluid communication with the air passage at least partially defined by the inner tube.

6. The fuel nozzle as in claim 4, wherein a flange of the gas-only cartridge at least partially defines at least one air circuit, wherein the air circuit is in fluid communication with the air passage at least partially defined by the inner tube.

7. The fuel nozzle as in claim 1, wherein at least one fuel port of the plurality of fuel ports of the fuel distribution tip is axially offset from a circumferentially adjacent fuel port of the fuel distribution tip.

8. The fuel nozzle as in claim 1, wherein a flange of the gas-only cartridge is formed to connect to an outer surface of an end cover of a gas turbine combustor.

9. A combustor, comprising:

an end cover coupled to an outer casing;

a fuel nozzle having a base portion coupled to one side of the end cover, the fuel nozzle comprising:

a center body coupled to and coaxially aligned with the base portion;

a tip body disposed at a downstream end of the center body, the tip body defining an opening that extends axially through the tip body and including a plurality of channels circumferentially spaced and positioned along an inner surface of the tip body within the opening, wherein each channel defines a flow passage through an upstream surface and a downstream surface of the tip body; and a gas-only cartridge that extends axially within the center body, the gas-only cartridge having an outer tube, an inner tube extending axially within the outer tube and a fuel passage defined therebetween, wherein the outer tube and the centerbody define a secondary premix air passage therebetween, the gas-only cartridge further comprising a fuel distribution tip that extends at least partially through the opening of the tip body, the fuel distribution tip including a plurality of circumferentially spaced fuel ports in fluid communication with the fuel passage, wherein each fuel port is in fluid communication with a respective channel of the tip body and each channel is in fluid communication with the secondary premix air passage.

10. The fuel nozzle as in claim 9, wherein the inner surface of the tip body forms multiple seals against an outer surface of the fuel distribution tip between each circumferentially adjacent channel of the plurality of channels.

11. The gas turbine as in claim 9, wherein the inner tube of the gas-only cartridge at least partially defines an air passage within the gas-only cartridge, wherein the fuel distribution tip of the gas-only cartridge defines at least one aperture disposed along a downstream surface of the fuel distribution tip, and wherein the aperture is in fluid communication with the air passage at least partially defined by the inner tube.

12. The gas turbine as in claim 9, wherein at least one fuel port of the plurality of fuel ports of the fuel distribution tip is axially offset from a circumferentially adjacent fuel port of the fuel distribution tip.

* * * * *